United States Patent [19]

Taylor

[11] 4,088,416

[45] May 9, 1978

[54] ROAD STUDS

[75] Inventor: Christopher Taylor, Lutterworth, England

[73] Assignee: Molehurst Limited, Leicester, England

[21] Appl. No.: 721,641

[22] Filed: Sep. 8, 1976

[30] Foreign Application Priority Data

Sep. 11, 1975 United Kingdom ..... 37412/75

[51] Int. Cl.[2] ..... E01F 9/04

[52] U.S. Cl. ..... 404/16

[58] Field of Search ..... 404/10, 11, 16, 15

[56] References Cited

U.S. PATENT DOCUMENTS

| | | | |
|---|---|---|---|
| 1,927,756 | 9/1933 | Ross | 404/16 |
| 2,703,038 | 3/1955 | Shaw | 404/16 |
| 2,941,447 | 6/1976 | Abbott | 404/11 X |
| 3,502,008 | 3/1970 | Macrae | 404/16 X |
| 3,516,337 | 6/1970 | Gubela | 404/16 X |
| 3,717,076 | 2/1973 | Shields | 404/11 |
| 3,850,536 | 11/1974 | Kane | 404/11 |
| 3,971,623 | 7/1976 | Hedgewick | 404/11 X |
| 3,980,410 | 9/1976 | Suhr | 404/16 |

*Primary Examiner*—Nile C. Byers
*Attorney, Agent, or Firm*—J. Rodman Steele, Jr.

[57] ABSTRACT

A reflection road stud comprising a body member attached or attachable to a road surface without excavation thereof, a reflector assembly mounted in or integral with the body member and comprising at least one reflex reflecting surface, means for wiping the reflecting surface when a road wheel of a vehicle passes over the road stud, and a region of resilient deformability disposed between the reflector assembly and the road surface when the road stud is attached thereto, whereby, when a road wheel of a vehicle passes over the road stud the reflector assembly is depressed towards the road surface and returns substantially to its initial position when the depressing force of the road wheel is removed.

13 Claims, 17 Drawing Figures

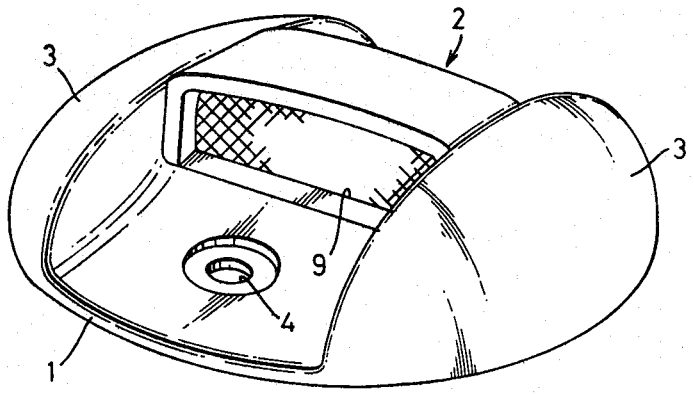
Fig. 1
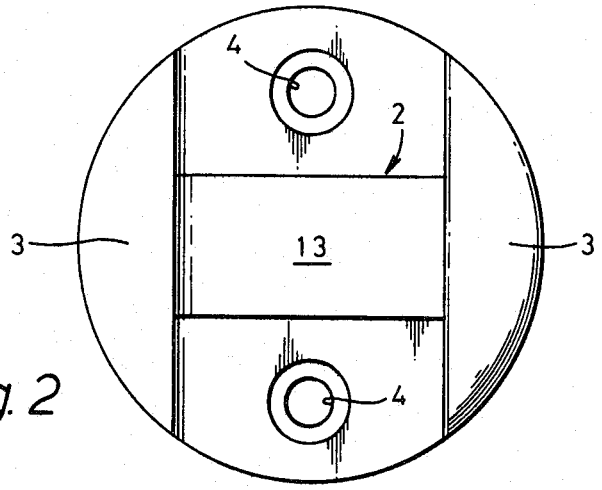
Fig. 2
Fig. 4
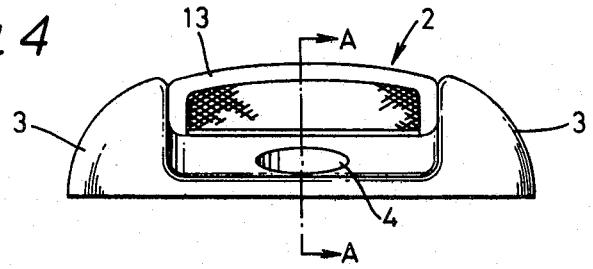

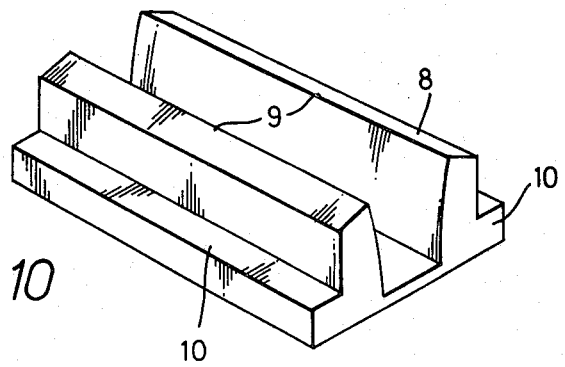
Fig. 10
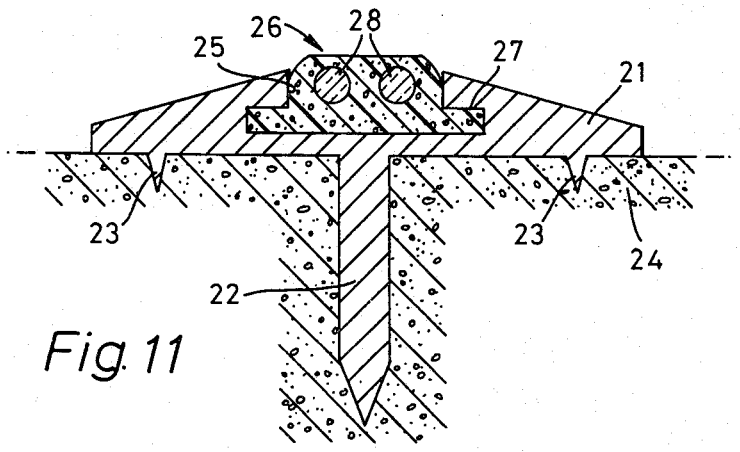
Fig. 11
Fig. 12
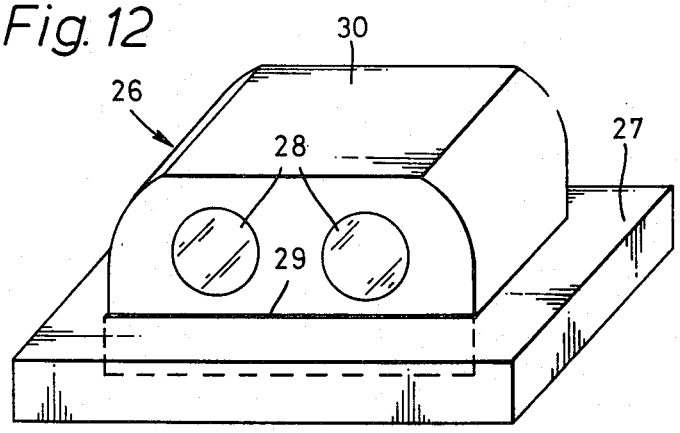

ROAD STUDS

This invention relates to road studs and is especially concerned with the provision of road studs which incorporate one or more reflecting surfaces. Such studs are primarily for use to assist drivers driving at night, without adequate street lighting, when it is most important that the boundaries of road lanes should be clearly delineated.

The most widely used reflecting road stud is that known under the trade mark "Catseye", and this consists, basically, of three main components, namely a cast iron base, a rubber pad mounted therein, and a lens or lenses. The lenses, and there are normally four of them, are bi-convex glass lenses each contained within a copper tube mount and secured to the lens holder, namely the rubber pad, by copper anchor dowels. The lens holder is fitted inside the cast iron base, which thus acts as a mount for the lenses/holder assembly and protects this assembly from vehicle damage.

Road studs of this type are extremely efficient, and widely acclaimed as such, but they do suffer from certain disadvantages. For example, in really wet weather, such as encountered in some countries, water collects in the cavity beneath the lens holder, and if the weather is cold enough this may freeze. Dirt can similarly accumulate in this cavity, and may not be completely flushed out. In either of these conditions, the lens holder will not be able to depress sufficiently to permit the frequent wiping of the lenses that is necessary for the lenses to perform satisfactorily as a reflector. A second disadvantage of this type of road stud is that its installation is a laborious operation. Thus, in order to install one of these road studs, part of the road has to be excavated, followed by the concreting and grouting of the stud in position. Their removal is, consequently, also laborious, and in most cases this has to be effected no later than five years after installation, it being normal practice to re-surface most roads at maximum intervals of five years. The normal procedure for re-surfacing roads involves the burning off of the existing surface, making good of any holes or cracks, and then the re-surfacing. It will be appreciated that road studs of the above type have to be removed before any of this re-surfacing work can begin.

An alternative form of reflecting road stud comprises a plastic shell containing a "corner cube" -type reflector. The reflector has a smooth sloping face, and the body of the shell contains a filler which is specially formulated to absorb impacts from traffic. This form of road stud also has disadvantages, however, amongst these being the fact that it is not particularly robust, and thus has poor durability in normal day to day traffic conditions, and the fact that its installation, which involves its being attached to the surface by means of adhesive, e.g. an epoxy resin, requires that portion of the road to which the road studs have been applied to be protected from traffic for some hours, i.e., until the resin has set. This form of road stud is therefore more commonly used as an edge marker rather than a lane delineator.

It is an object of the present invention to provide a reflecting road stud which is cheap to manufacture, easy to install and remove, and efficient in operation.

According to the present invention a reflecting road stud comprises a body member attached or attachable to a road surface without excavation thereof, a reflector assembly mounted in or integral with the body member and, comprising at least one reflex reflecting surface, means for wiping the reflecting surface when a road wheel of a vehicle passes over the road stud, and a region of resilient deformability disposed between the reflector assembly and the road surface when the road stud is attached thereto, whereby, when a road wheel of a vehicle passes over the road stud the reflector assembly is depressed towards the road surface and returns substantially to its initial position when the depressing force of the road wheel is removed.

The "region of resilient deformability" may involve any means which allows the reflector assembly to return to its original position after the depressing force of a vehicle road wheel thereon has been removed. In a preferred embodiment the region of resilient deformability comprises a sealed cavity formed at least partly by the body member of the stud. Thus, the cavity may be formed wholly within the body member, or partly by the body member and partly by the surface of the road to which the body member is attached. When a vehicle wheel contacts the road stud part of it will be deformed into the cavity, and the reflector assembly will consequently be depressed. On removal of the depressing force the cavity will resume its original shape and size and will restore the reflector assembly to its initial position.

The cavity may contain resilient means, which may partly or wholly fill the cavity and will, when present, control the deformation of the cavity and thus of the body member. For example, the cavity may contain a spring; alternatively it may contain a material, e.g. a foam material, which is more resilient than the material of the body member.

In a preferred form of the invention the body member of the road stud is moulded from mouldable material such as natural or synthetic rubber, the lens holder of the reflector assembly being moulded integrally therewith, and a cavity being formed between the reflector assembly holder and the road-engaging surface of the body member. Such a cavity may be formed by forming the major part of the body member, including the lens holder, with a bottom-facing opening, and then sealing the opening, optionally after partly or completely filling it with resilient material, with a base plate, suitably of the same material as the rest of the body member.

In another embodiment the reflector assembly is formed separately from the body member and is retained in a hollow formed in the body member and supported therein by, or seated on, a mass of resiliently deformable material contained within the hollow.

It is preferred that the road stud of the invention should be attached to a road surface by means of nails, studs or spikes, which may be integral with or separate from the body member or a protecting shield with which the member is provided. One or more such studs, nails or spikes may be used to attach each stud to the road surface. Attachment of the stud to the road surface will not, therefore, involve any excavation of the latter. In another construction the road stud may be stuck on the road surface.

The reflector assembly comprises one or more reflex reflecting surfaces and a holder therefor, which holder is suitably, but not necessarily, formed as an integral part of the body member, as outlined above. Normally the reflecting surface or surfaces will stand proud of the main part of the body member, but will be pressed towards the road-surface when depressed by a wheel of a road vehicle. The reflecting surface or surfaces must clearly return quickly to their protruding position when the vehicle has passed, and for this purpose we provide the body member with a region of resilient deformability as explained hereinabove. In this way, when the depressing force of a road vehicle is removed, the reflector assembly may return to its original position, with the reflecting surface or surfaces standing proud of the rest of the body member. The resiliently deformable material, from which the body member may be formed, or which may partly or wholly fill the abovementioned cavity and hollow, may be of any suitable type, and examples include natural and synthetic rubbers, and plastic foams. We have found a high density polyurethane foam to be especially useful, both for the body of the stud itself and also for the deformable material filling the cavity and the hollow where appropriate.

The reflecting surface or surfaces of the road stud of the present invention are of the reflex reflecting sort. There are commonly two main types of reflex reflector, namely those involving refraction and those based on the principle of total internal reflection. Thus, the reflector of the road stud of the invention may be of the bi-convex type used in "Catseyes" hitherto, or of the "corner-cube" type.

The reflector wiper may be an integral part of the reflector holder, and thus also of the body of the stud when the holder and body are integral, when the holder is formed of a resiliently deformable material, but otherwise the wiper is a separate component, for example of rubber or plastics material, formed with one or more wiping edges. The vertical reciprocation of the reflector holder, due to the passage thereover of the vehicle, causes the reflecting surface or surfaces to be "swept" by the wiping edges of the wiper.

It is an important feature of the road stud of the invention that any cavity formed in the body member, or between the body member and the adjacent road surface, when such a cavity is used in the provision of the resiliently deformable region, should at all times be sealed. This ensures that no water or dirt can accumulate in the cavity, so that the deforming action of the reflector assembly is not impaired.

The body member of the stud of the invention may be required to withstand, in certain conditions, fairly rough treatment, for example, where snow ploughs or tracked vehicles are in evidence, and for this purpose it may be formed of a material having itself the property of being relatively rigid. Alternatively a rigidifying element, for example a steel plate, may be incorporated in the body member itself, or, again as an alternative, the body member may be provided with a rigid protective shield, e.g. an aluminium or steel casting through an opening in which the lens holder protrudes.

Some embodiments of the invention will now be described with reference to the accompanying diagrammatic drawings, in which:

FIG. 1 is a perspective view of one form of road stud in accordance with the invention;

FIGS. 2 and 3 are, respectively, top and bottom plan views;

FIG. 4 is a front or rear view of the road stud of FIG. 1;

FIG. 10 is an illustration of the wiper of the stud of FIGS. 1–9;

FIG. 11 is a sectional view of another form of road stud, shown attached to a road surface;

FIG. 12 is a perspective view of the reflector assembly of the road stud of FIG. 11;

Figure 3:
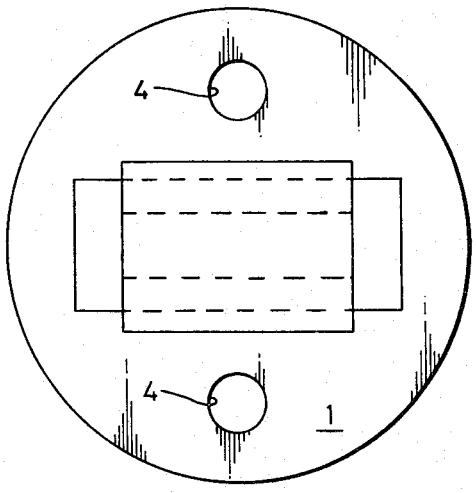
Figure 5:
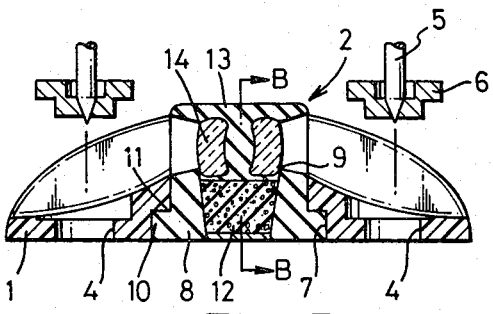
FIG. 5 is a section on the line A—A of FIG. 4, showing also means of affixing the road stud to a road surface.
Figure 6:
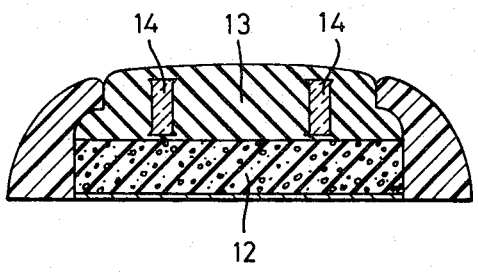
FIG. 6 is a section on the line B—B of FIG. 5.
Figure 7:
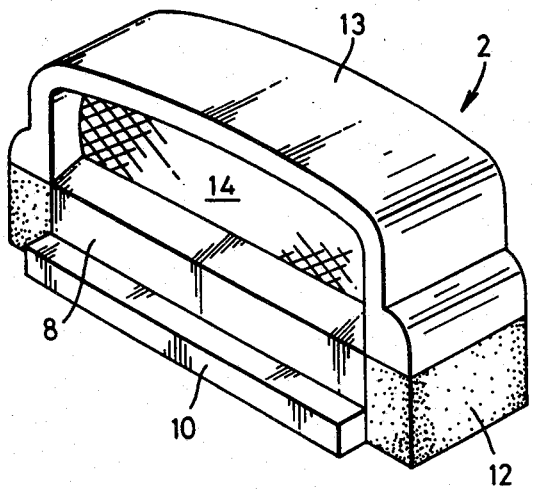
FIG. 7 is an elevation of the reflector assembly of the road stud of FIGS. 1 to 6.

Referring firstly to FIGS. 1 to 10, the road stud comprises a rigid body member 1 and a reflector assembly designated generally 2. The body member 1 is of a rigid material, and thus may be for example of a metallic material or a plastics material. The use of a plastics material for the body member 1 enables the entire road stud to be burnt off the surface of the road if the road stud is required to be removed, for example for re-surfacing operations. The body member 1 is provided with arcuately-shaped shoulders 3, for protection of the relector assembly 2. Holes 4 are provided in the body member 1 for the reception of nails, spikes or studs 5, which are suitably provided with collars 6 which accurately fit holes 4. The use of such collars 6 enables nails 5 to be used which are smaller than would otherwise be necessary for holes 4. If desired, the holes 4 could be provided with a splined surround, to enable the use of different sized nails. A hollow 7 formed in the base member 1 is filled by the reflector assembly 2. This assembly comprises a rubber or plastics moulding 8 having flexible edges 9 which constitute wipers for the reflecting surfaces of the reflector assembly. The moulding 8 is provided with longitudinal flanges 10 which are retained beneath over-hanging ledges 11 formed on the body member 1. By this means the wiper is retained in place. The central hollow portion of the wiper 8 is filled with a mass of resiliently deformable material 12. This may, for example, comprise a rubber or plastics, e.g. polyurethane, foam, the material 12 having substantially an I-section when viewed in plan (see FIGS. 7 and 9), and constituting a resiliently deformable region. Seated on top of the deformable material 12 is a holder 13, suitably of deformable material such as natural or synthetic rubber, which is moulded around, and carries, a reflector 14 of the corner cube type.

The road stud of FIGS. 1 to 10 is attached to the surface of the road by hammering in the spikes 5. The spikes or studs 5 may be of the expanding nail type. The stud is mounted so that the reflecting surfaces face in the direction of traffic flow. When a road wheel passes over the stud it contacts the top of holder 13, and depresses this in the manner of a plunger. Deformable core material 12 is compressed, allowing holder 13 to move downwardly relative to wiper 8 and cause the wiping blades 9 to pass over, and clean, the surfaces of the reflector 14. When the vehicle has passed, the resilient nature of the material 12 causes the holder 13 to revert to its initial position as shown in the drawings.

An alternative road stud is shown in FIGS. 11 and 12. This is of a much simpler form, and comprises a body member 21, suitably of metal or a plastics material, formed with a central spike 22 and two lateral aligning spikes 23, by which it is attached to road surface 24. In a cavity 25 formed in body member 21 is retained a reflector assembly 26, shown enlarged in FIG. 12, comprising a solid core of resiliently deformable material such as polyurethane foam. The body is formed with a peripheral flange 27, whereby it is retained in an undercut formed in the base member 21, and is provided with four reflectors 28 of the bi-convex type. A longitudinal slit 29 is cut through the thickness of the holder 26 at each end of the reflector assembly. Thus, during passage of a road wheel over this assembly, whilst flange 27 is held stationary in the base member, the body portion 30 of the holder 26 is depressed relatively to it, causing the lenses of the reflectors 28 to contact the edge of the flange 27 formed by the cut 29, which "wipes" the lenses.

Figure 13:
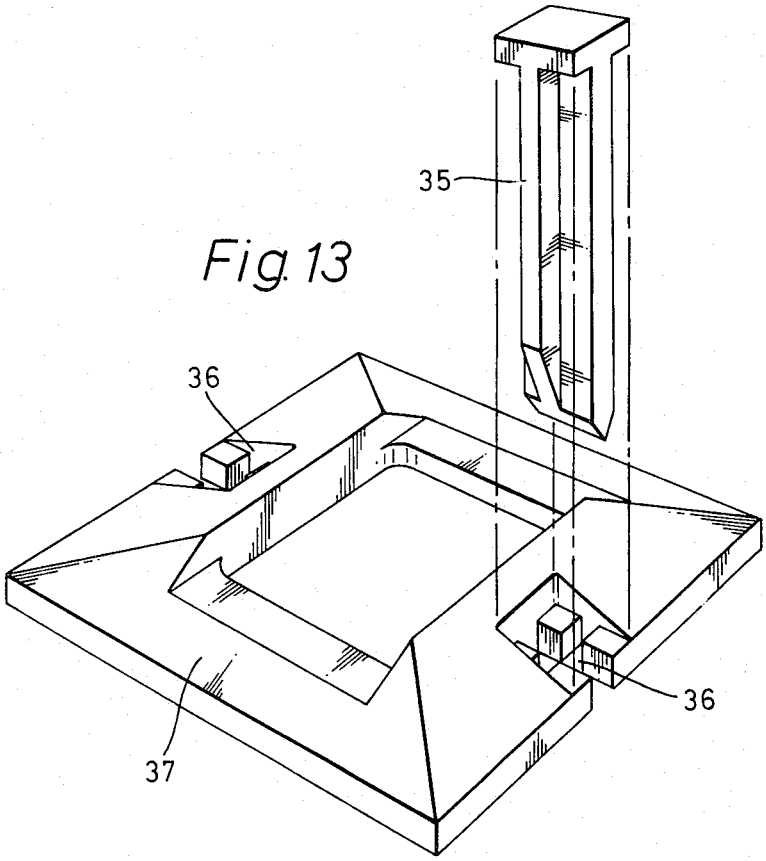
FIGS. 13–15 are illustrations of various different forms of base member for use with a reflector assembly of the type shown in FIG. 12.
Figure 14:
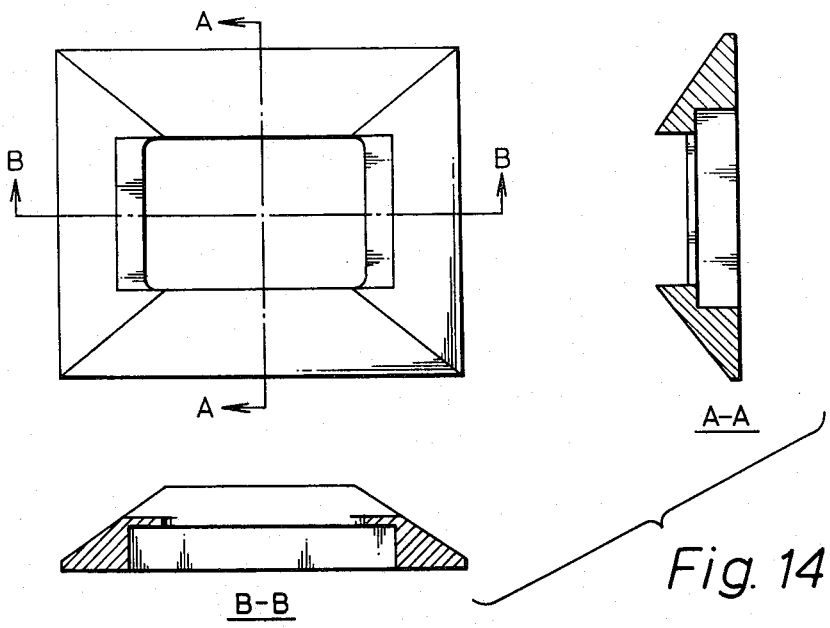
Figure 15:
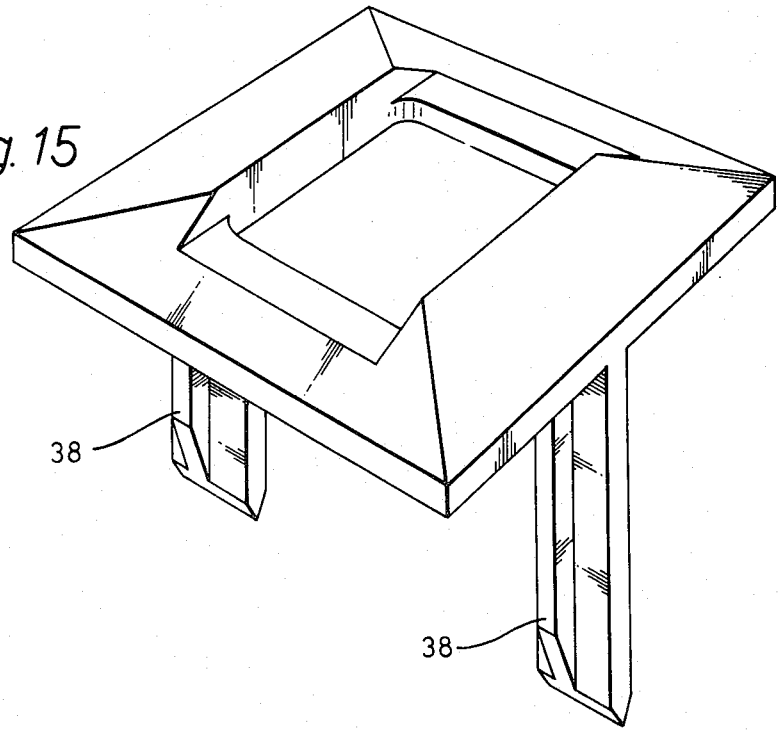

Alternative base members are shown in FIGS. 13–15. That shown in FIG. 13 is similar to the base member 21 shown in FIG. 11, but no integral spikes are provided. Instead, separate spikes 35 of cruciform shape co-operate with and are retained by suitably formed holes 36 in two opposite sloping faces of the base member 37.

A base member suitable for adhesion to a road surface is shown in FIG. 14.

The base member shown in FIG. 15 is similar to that of FIG. 13, but has integrally formed spikes 38 instead of the separately formed spikes 35. Spikes of this particular configuration are especially suitable for use where the substrate of the road is particularly poor, e.g. on minor roads, or when substantial resistance to "creep" has to be provided. Otherwise it is in order to attach the road studs to the road surface by more conventional nails or spikes, depending on the nature of the surface, e.g. concrete or tarmacadam. For most applications masonry nails of e.g. ¼ inch diameter and up to e.g. 3 inches long would be adequate.

Figure 8:
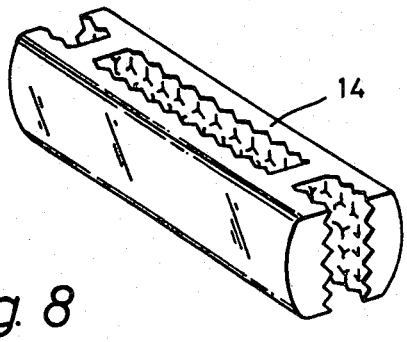
FIG. 8 is a view of the reflector itself, of the "corner cube" type.
Figure 9:
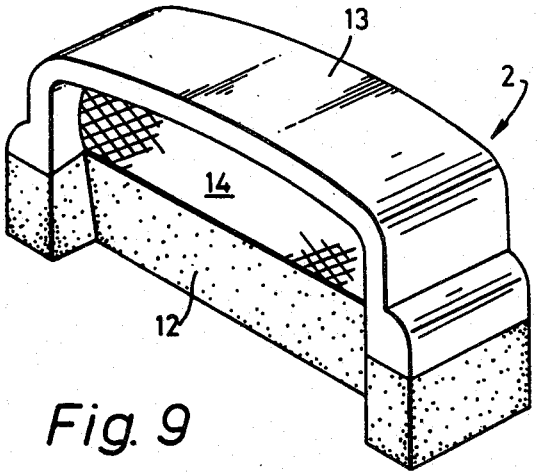
FIG. 9 is a view of the reflector mounted in its holder.
Figure 16:
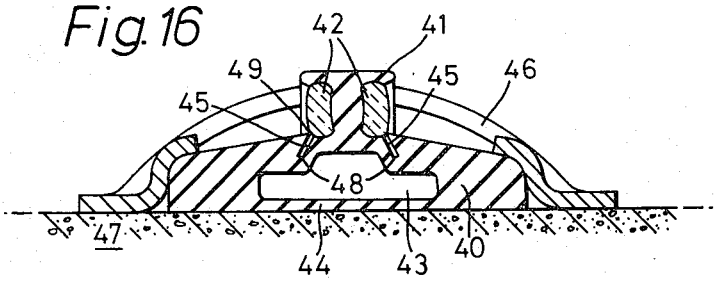
FIGS. 16 and 17 are sectional views of two further forms of road stud.

The road stud illustrated in FIG. 16 comprises a body 40 integrally moulded, from for example a synthetic rubber, with a reflector assembly 41 containing corner-cube type reflectors 42 similar to that shown in FIG. 8. The stud is circular in plan and the body 40 is formed with a hollow cavity 43 by moulding the major part of the body with an open-ended hollow 43 and sealing this with a base plate 44 made from similar or compatible material to that of the rest of the body 40. The body is formed with two transverse cuts or slots 45 and is surrounded by a metal protective shield 46 by means of which the stud is fastened to the road surface 47.

When a road wheel of a vehicle passes over the stud shown in FIG. 16 the reflector assembly 41 is depressed and "hinges" about the lines 48 representing the lowermost portions of slots 45. This downwards movement of reflector assembly 41 is taken up by the cavity 43, into which part of the reflector assembly 41 moves, and it will be seen that during this downward movement of assembly 41 the outer boundaries 49 of the slots 45 contact and wipe the faces of the reflectors 42. On removal of the wheel from the stud, the reflector assembly 41 "springs" back to its normal position as shown in FIG. 16.

Figure 17:
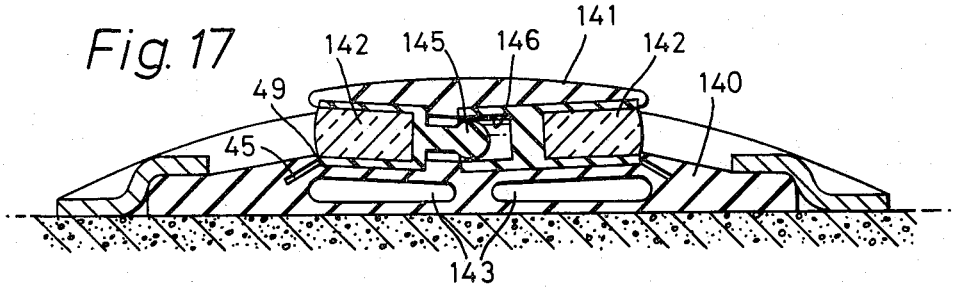

The construction of the road stud shown in FIG. 17 is broadly similar to that of FIG. 16, save that the reflector assembly 141 is modified to accommodate lenses 142 of the bi-convex type, and that two cavities 143 are provided in the body 140. The lenses 142 are retained within tube mounts 144 which are moveable relatively to each other, as is inevitable during use, by means of a spigot 145 on one of them sliding in a cylindrical extension 146 of the other.

The operation of the FIG. 17 embodiment is similar to that of the FIG. 16 construction.

What we claim is:

1. A reflecting road stud, comprising:

a surface-mounted body member, said body member having a central hollow region open to at least the top of the body member;

a resilient, deformable material substantially filling said hollow region, said material having an upper portion with at least one side thereof visible from without said body member and a lower portion having a peripheral flange;

a reflector assembly mounted into said at least one visible side, said reflector assembly having at least one substantially vertical reflex reflecting surface;

a substantially vertical slit through said lower portion, co-extensive with said at least one visible side of said upper portion, said slit forming a wiping surface oppositely disposed to and below said at least one reflecting surface; and, said material being sufficiently deformable to permit said upper portion with said reflector assembly to be momentarily depressed into said lower portion as the road wheel of a vehicle passes over said body member, said at least one reflector surface being wiped clean as it contacts said wiping surface.

2. The reflecting road stud of claim 1, wherein said hollow region further comprises an undercut in said body member, in which said peripheral flange is seated, thereby retaining said resilient material in said body member.

3. The reflecting road stud of claim 1, further comprising:

a second visible side on said upper portion of said resilient material;

a second reflecting surface in said reflector assembly, mounted into said second visible side; and, a second substantially vertical slit through said lower portion, co-extensive with said second visible side of said upper portion, said second slit forming a second wiping surface oppositely disposed to and below said second reflecting surface.

4. The reflecting road stud of claim 1, wherein said hollow region is open only to the top to said body member.

5. The reflecting road stud of claim 1, wherein said resilient material is more resilient than said body member.

6. The reflecting road stud of claim 1, wherein said resilient material is a foam material.

7. The reflecting road stud of claim 6, wherein said foam material is a high density polyurethane foam.

8. A reflecting road stud, comprising:

a surface-mounted body member, said body member having a central hollow region open to at least the top of the body member, comprising:

a resilient material substantially filling said hollow region, said material having a smaller upper portion with at least one side thereof visible from without said body member and a larger lower portion;

a reflector assembly mounted into said at least one visible side, said reflector assembly having at least one substantially vertical reflecting surface;

a diagonal slot in said lower portion, coextensive with and directed outwardly from said at least one visible side of said upper portion, said slot forming a wiping edge oppositely disposed to and below said at least one reflecting surface;

said material having at least one cavity in said lower portion thereof, disposed beneath said upper portion and extending in part above the level of the bottom of said slot and, said material being sufficiently resilient to permit said upper portion with said reflector assembly to be momentarily depressed into said at least one cavity as the road wheel of a vehicle passes over said body member, said at least one reflector surface being wiped clean as it contacts said wiping edge.

9. The reflecting road stud of claim 8, wherein said central hollow region is open only to the top of said body member.

10. The reflecting road stud of claim 8, further comprising:

a second visible side on said upper portion of said resilient material;

a second reflecting surface in said reflector assembly mounted into said second visible side; and, a second diagonal slot cut in said lower portion, coextensive with and directed outwardly from said second visible side of said upper portion, said slot forming a second wiping edge oppositely disposed to and below said second reflecting surface.

11. The reflecting road stud of claim 8, wherein said reflector assembly comprises two pivotally connected reflector housings.

12.The reflecting road stud of claim 11, wherein said material has two cavities in said lower portion thereof, said cavities being respectively disposed beneath said reflector housings.

13. The reflecting road stud of claim 8, wherein said resilient material is a synthetic rubber.

* * * * *